United States Patent [19]

Oguchi

[11] 4,357,116

[45] Nov. 2, 1982

[54] PRINTER CONTROL ASSEMBLY

[75] Inventor: Yuhei Oguchi, Shiojiri, Japan

[73] Assignees: Shinshu Seiki Kabushiki Kaisha, Nagano; Kabushiki Kaisha Suwa Seikosha, Tokyo, both of Japan

[21] Appl. No.: 219,541

[22] Filed: Dec. 23, 1980

[51] Int. Cl.[3] ..... B41J 23/34

[52] U.S. Cl. ..... 400/184; 400/187; 400/121; 400/621; 101/93.07; 235/3

[58] Field of Search ..... 400/184, 185, 186, 187, 400/95, 96, 121, 621, 124, 154.2; 101/93.05, 93.07, 93.29, 99; 235/3, 58 CF, 58 P

[56] References Cited

U.S. PATENT DOCUMENTS

| | | | |
|---|---|---|---|
| 3,478,959 | 11/1969 | Rethmeier | 235/3 |
| 3,517,877 | 6/1970 | Englund et al. | 235/3 |
| 3,939,955 | 2/1976 | Menzi | 400/186 |
| 4,051,942 | 10/1977 | Suzuki et al. | 400/154.2 X |
| 4,218,151 | 8/1980 | Kondur, Jr. | 400/185 X |
| 4,259,026 | 3/1981 | Hanaoka et al. | 400/124 |
| 4,293,236 | 10/1981 | Shimizu | 101/93.07 X |

FOREIGN PATENT DOCUMENTS

| | | | |
|---|---|---|---|
| 2263518 | 7/1974 | Fed. Rep. of Germany | 400/320 |

*Primary Examiner*—Paul T. Sewell
*Assistant Examiner*—Daniel J. Roock
*Attorney, Agent, or Firm*—Blum, Kaplan, Friedman, Silberman & Beran

[57] ABSTRACT

A printer for an electric cash register or the like which performs at least two print related functions. The printer includes a printing head adapted for lateral displacement across a printing paper for effecting printing on the paper. The printer also includes a drive mechanism for effecting the lateral displacement of the printing head and a paper feeding mechanism for advancing the printing paper. The printer may also include a stamping mechanism, an automatic receipt paper cutting mechanism and a journal paper winding mechanism. Each of these mechanisms includes a control lever for actuating the operation thereof. A displaceable selecting lever is arranged and constructed to selectively operate each of the control levers. A single electromagnet controls the operation of the selecting lever.

33 Claims, 21 Drawing Figures

PRINTER CONTROL ASSEMBLY

BACKGROUND OF THE INVENTION

This invention is directed to a printer and, in particular, to a serial printer for an electric cash register or the like which includes a single electromagnet for controlling the operation of each of the various mechanisms included in the printer.

In a conventional printer such as a dot printer for an electric cash register (ECR), there are various mechanisms which perform different functions in the printer. The conventional printer generally includes a laterally translatable printing head for effecting printing across a line of printing paper or tape, a paper feeding mechanism for advancing the receipt and journal papers past the printing head, a stamping mechanism for stamping a name, logo or the like on the receipt paper, an automatic cutting mechanism for cutting off the receipt paper from the paper roll and a journal paper winding mechanism for winding the journal cash register tape on a roller in the cash register after printing has been effected thereon. A driving mechanism is also provided for laterally translating the printing head across the surfaces of the printing papers.

Each of the above mechanisms in the conventional printer operated independently of one another. In order to operate each of the various mechanisms, each separate mechanism required its own actuating device such as an electromagnet. Each electromagnet required an independent driver in the driving circuit of the printer. Therefore, conventional printers included a large number of parts and a large size structure. Additionally, because of the many parts in the conventional printer, the cost thereof was generally increased. Accordingly, a printer for an electric cash register or the like which includes a single electromagnet for driving the various mechanisms and the printing head in the printer, is desired.

SUMMARY OF THE INVENTION

Generally speaking, in accordance with the instant invention, a printer for an electric cash register or the like adapted to perform at least two print related functions is provided. The printer includes a printing head which may be a dot printing head which is laterally translatable across the surface of a printing tape or paper. The printer also includes a drive mechanism for laterally displacing the printing head and paper feeding mechanisms for feeding the receipt and journal papers through the printer. The printer may also include a stamping mechanism for stamping the store name or logo on the receipt paper, an automatic cutting mechanism for cutting off the receipt paper after printing has been effected thereon and a journal paper winding mechanism for winding the journal paper in the printer after printing has been effected thereon. Each of these mechanisms includes a control lever which actuates and controls the start and stop of the particular mechanism of which it is a part. A selecting lever is operatively coupled to each of the control levers for selectively operating same.

A single electromagnet controls the operation of the selecting lever and, hence, of each of the mechanisms included in the printer, as well as translation of the printing head. Since only one electromagnet is required, a single driver for the electromagnet is necessary. The number of parts in the printer is reduced and the structure is substantially minaturized. The reduction in the number of parts reduces the cost of the printer.

Accordingly, it is an object of the instant invention to provide an improved printer for an electric cash register or the like.

Another object of the instant invention is to provide an improved printer which includes various mechanisms wherein all of the mechanisms are operated by a selecting lever.

A further object of the instant invention is to provide an improved printer which includes a selecting lever for operating all of the mechanisms in the printer, the selecting lever being operated by a single electromagnet.

A still further object of the instant invention is to provide an improved printer wherein the number of parts is reduced thereby decreasing the size and cost of the printer.

Another object of the invention is to provide improved paper feeding and winding mechanisms for use in a printer.

A further object of the invention is to provide an improved stamping mechanism for use in a printer.

Yet another object of the invention is to provide an improved automatic cutting mechanism for a printer.

A still further object of the invention is to provide an improved driving mechanism for displacing the printing head in a printer.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
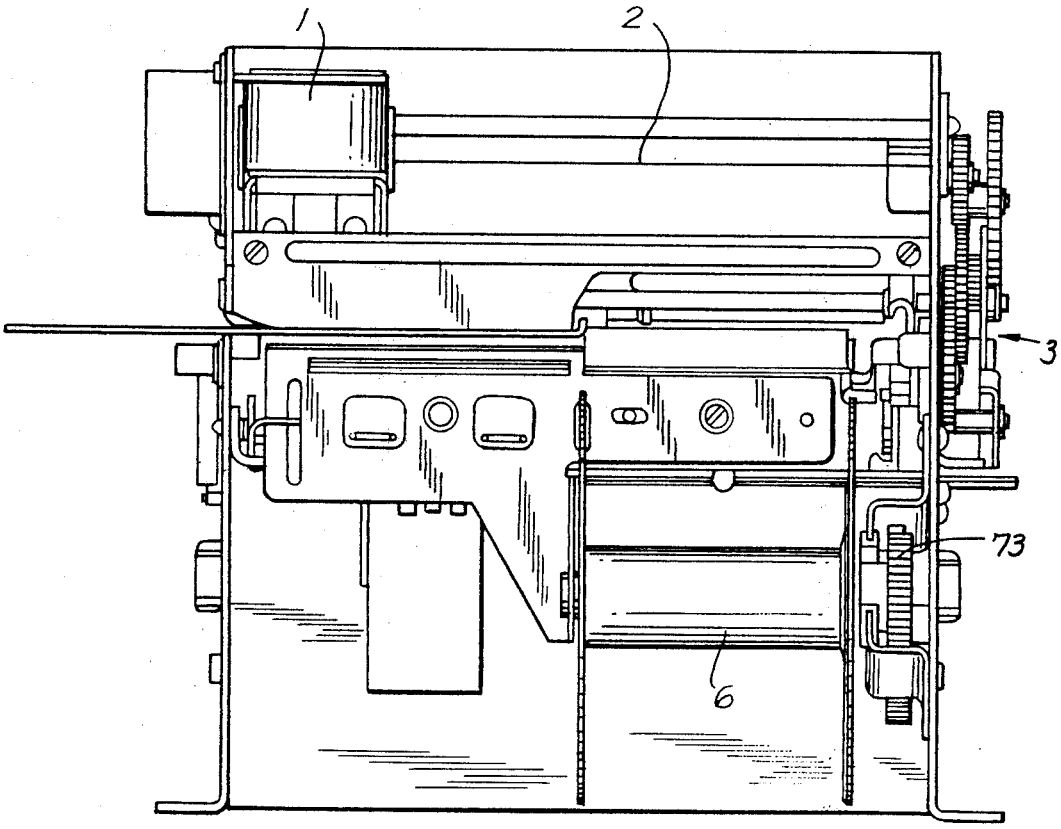
FIG. 1 is a front elevational view of a printer constructed and arranged in accordance with the instant invention.
Figure 2:
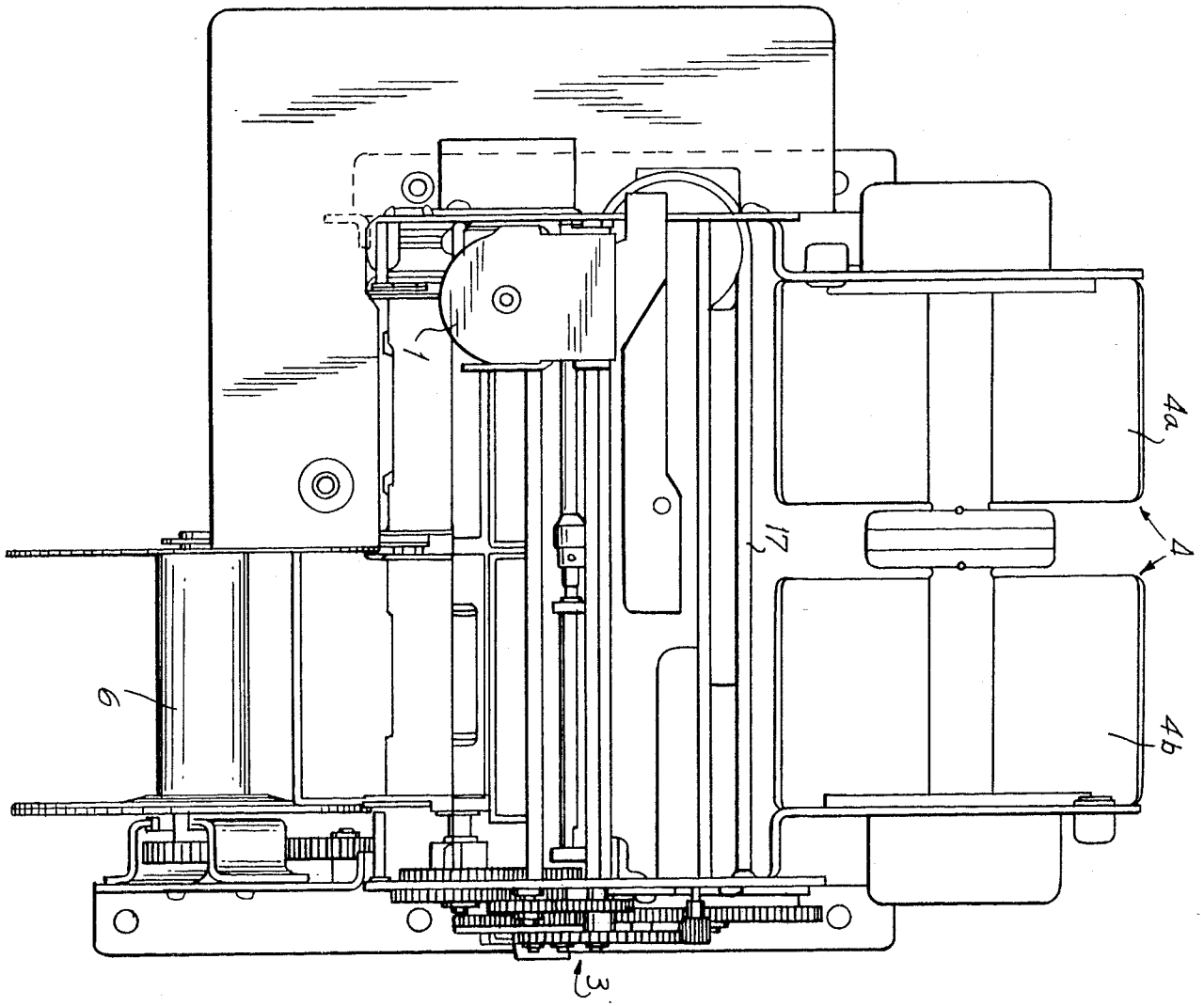
FIG. 2 is a top plan view of the printer illustrated in FIG. 1.
Figure 3:
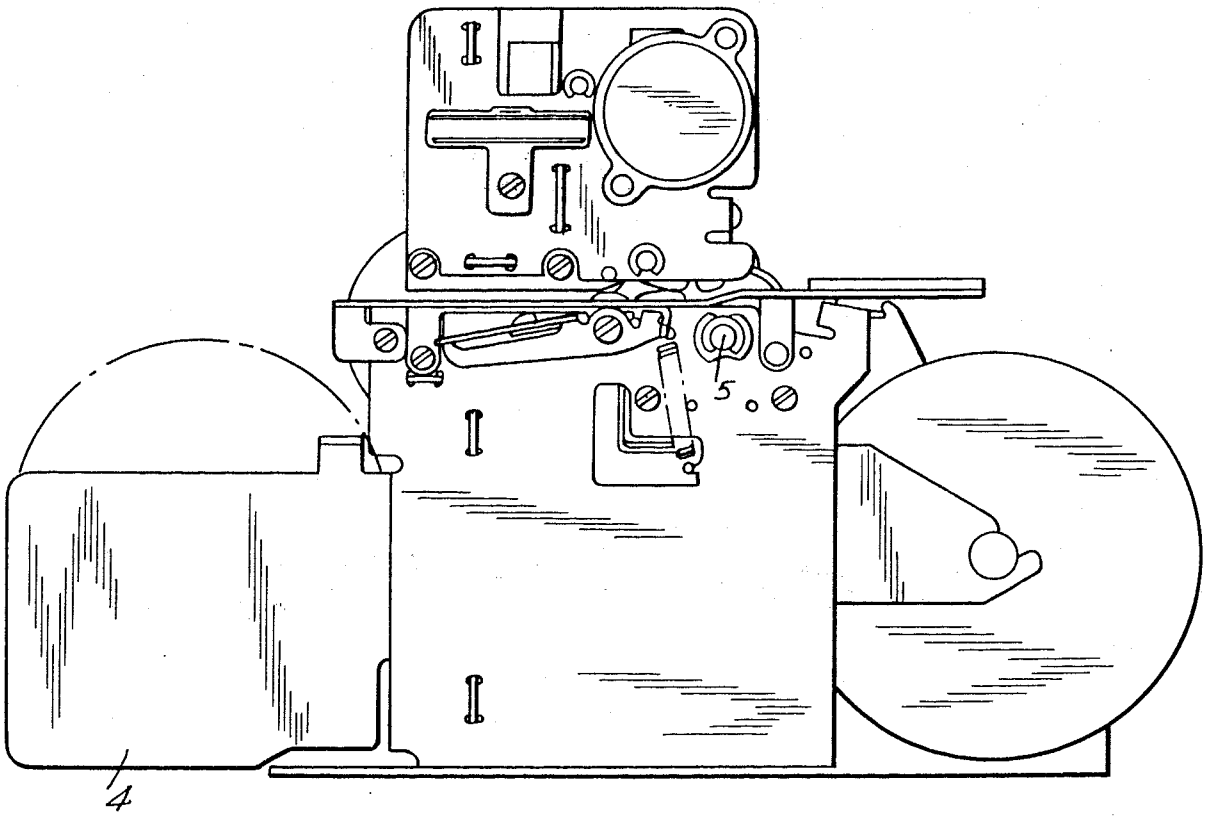
FIG. 3 is a left side elevational view of the printer depicted in FIG. 1.
Figure 4:
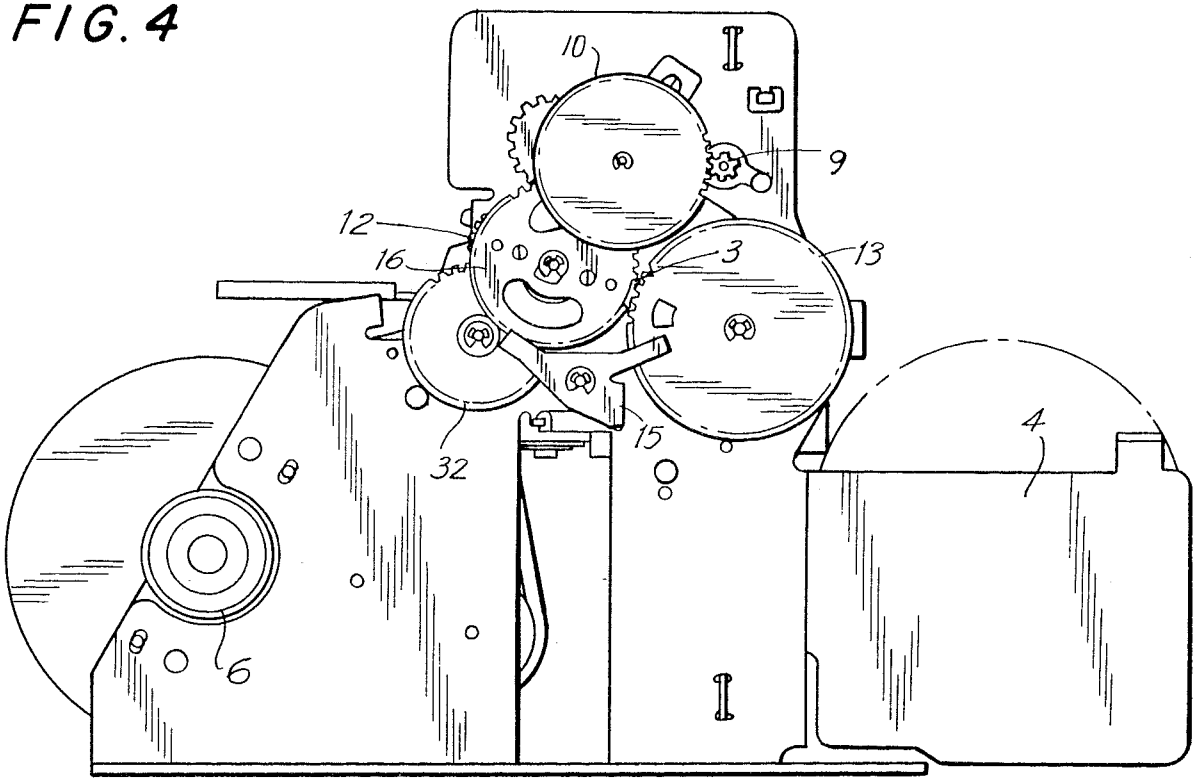
FIG. 4 is a right side elevational view of the printer depicted in FIG. 1.

Reference is first made to the FIGS. 1 through 4 wherein a printer for an electric cash register or the like, constructed and arranged in accordance with the instant invention, is depicted. The printer includes a dot printing head 1 which is adapted to print across a line of a printing paper or tape. A driving mechanism 3 is provided for driving printing head 1 by means of a wire 2 which causes printing head 1 to laterally translate across the surface of the printing paper. A supply mechanism 4 separately houses the receipt printing paper 4*a* and the journal printing paper 4*b*. The receipt printing paper is provided as a receipt to be given to the customer along with his purchase. The journal printing paper is stored in the cash register as a permanent record of all transactions.

A paper feeding mechanism 5 is provided for feeding (advancing) the required amount of receipt and journal printing papers through the printer. Also included in the printer are a paper winding mechanism 6 for winding the journal printing paper in the printer, a stamping mechanism for stamp-printing the name, logo or the like of the business on the receipt printing paper, and an auto-cutting mechanism for automatically cutting off the receipt paper from the roll after printing has been effected thereon.

In the conventional printer, each of the above mechanisms is actuated by its own electromagnet, each separate electromagnet requiring a separate driver. The present invention provides a construction wherein only one electromagnet is required to selectively actuate each of the various mechanisms in the printer. Since there is only one electromagnet, only one driver is required therefor. The construction of the various mechanisms of the printer will first be described. Thereafter, the complete printer constructed and arranged in accordance with this invention will be described in detail.

Figure 5:
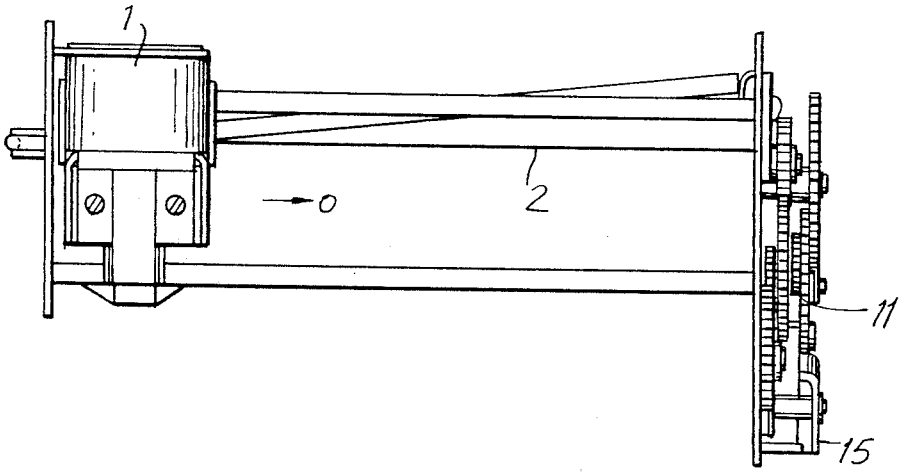
FIG. 5 is a front elevational view of the printing head and drive mechanism therefor utilized in the printer of the instant invention.
Figure 6:
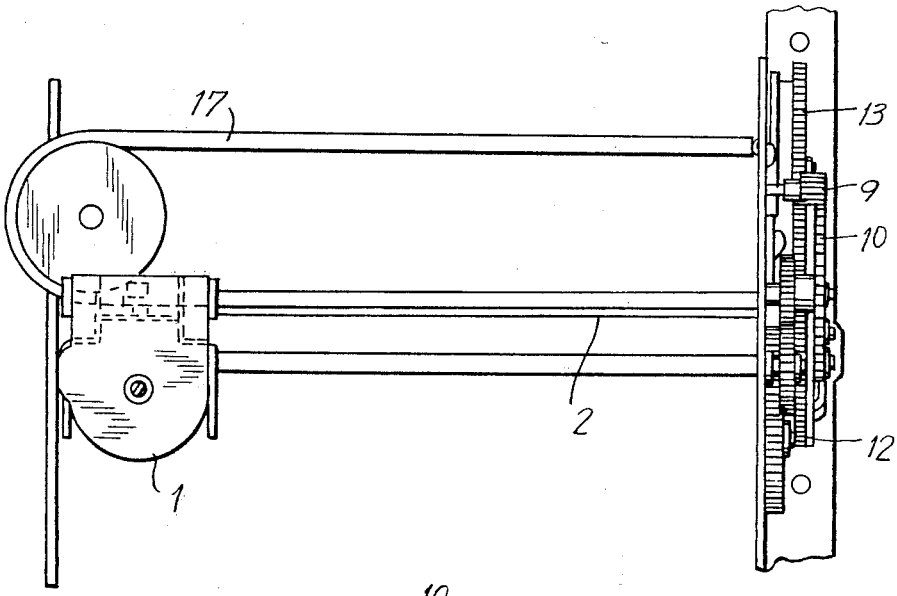
FIG. 6 is a top plan view of the printing head and drive mechanism depicted in FIG. 5.
Figure 7:
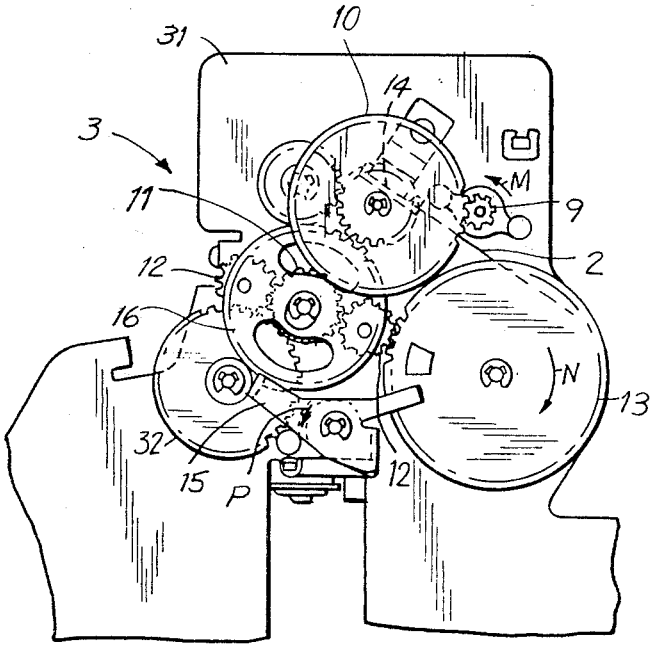
FIG. 7 is a right side elevational view of the printing head drive mechanism depicted in FIG. 5.

Reference is now made to FIGS. 5 through 7 in order to describe the construction of the driving mechanism 3 for printing dot head 1. As the drive shaft of motor 9 is rotated in the direction of arrow M, its rotation is transmitted by a reduction gear 10 to a planet driving gear 11. Planet driving gear 11 is rotatably coupled to planet gears 12 which are rotatably coupled 180° apart on planet lever 16. The planet gear 12 contacting a wire driving gear 13 will cause wire driving gear 13 to rotate in the direction of arrow N.

A first end of wire 2 is secured to dot head 1. Wire 2 extends through an opening in the side of frame 31 around a wire guiding roller 14. The other end of wire 2 is coupled to wire driving gear 13. A groove is provided around the perimeter of wire driving gear 13 for allowing wire 2 to be wound therearound. Accordingly, when wire driving gear 13 is rotated in the direction of arrow N, wire 2 is wound therearound in the concave groove and dot head 1 will be laterally translated in the direction of arrow O.

A planet locking or control lever 15 is pivotally mounted on frame 31 and is adapted to engage with a notch on planet lever 16 so as to hold one of the planet gears 12 against wire driving gear 13. In order to return dot head 1 to its standby position as depicted in FIG. 5 or 6, when the electromagnet (described below in detail) is activated, planet locking lever 15 will be rotated in the direction of arrow P and will disengage from the notch on planet lever 16 thereby allowing planet lever 16 to rotate. Due to the rotation of planet driving gear 11, planet lever 16 will rotate thus causing planet gear 12 to disengage from wire driving gear 13. Hence, dot head 1 will return to its initial standby position due to the force exerted thereon by a head returning spring 17. Also, wire driving gear 13 will return to its initial position due to the pull thereon by wire 2.

As dot head 1 reciprocates thereby printing one line across the printing paper, motor 9 will continue to rotate and the power will be shut off when dot head 1 returns to its standby position. Where further printing of lines on the printing paper is to occur, the motor will not be shut off and will continue rotating. In this case, planet lever 16 and planet gears 12 rotatably secured thereon will be further rotated and the planet gear 12 located 180° opposite the planet gear 12 which originally rotated wire driving gear 13, will engage with wire driving gear 13. At this time, planet locking lever 15 will engage with a second notch on planet lever 16 so as to stop the rotation thereof. Hence, the rotation of motor 9 will be translated through planet gear 12 to wire driving gear 13 and wire 2 will again be wound around wire driving gear 13 and dot head 1 will again translate across the printing paper. The characters for one line will be printed by one reciprocation of dot head 1.

Figure 8:
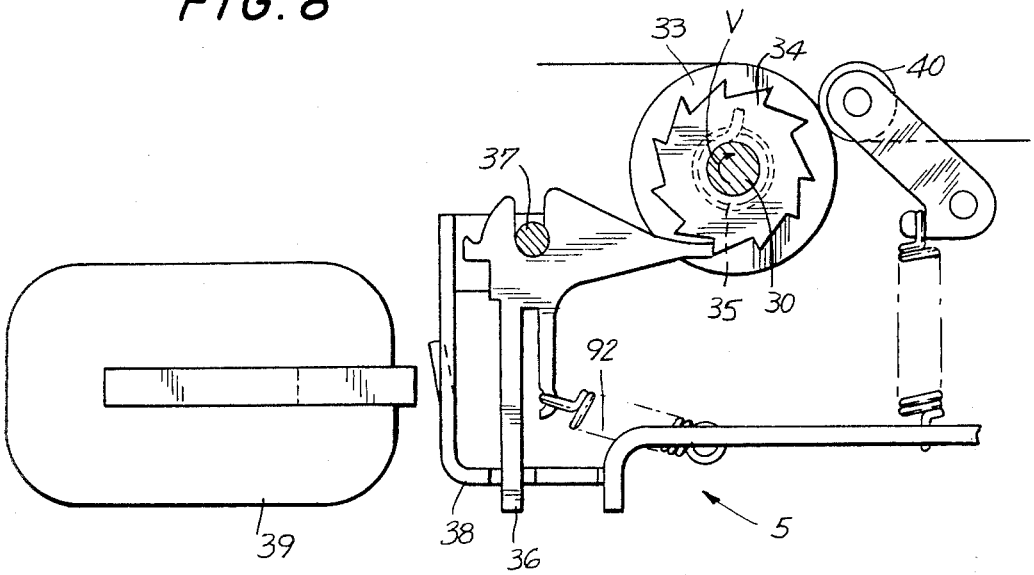
FIG. 8 is an enlarged side elevational view of the paper feeding mechanism utilized in the printer of the instant invention.
Figure 9:
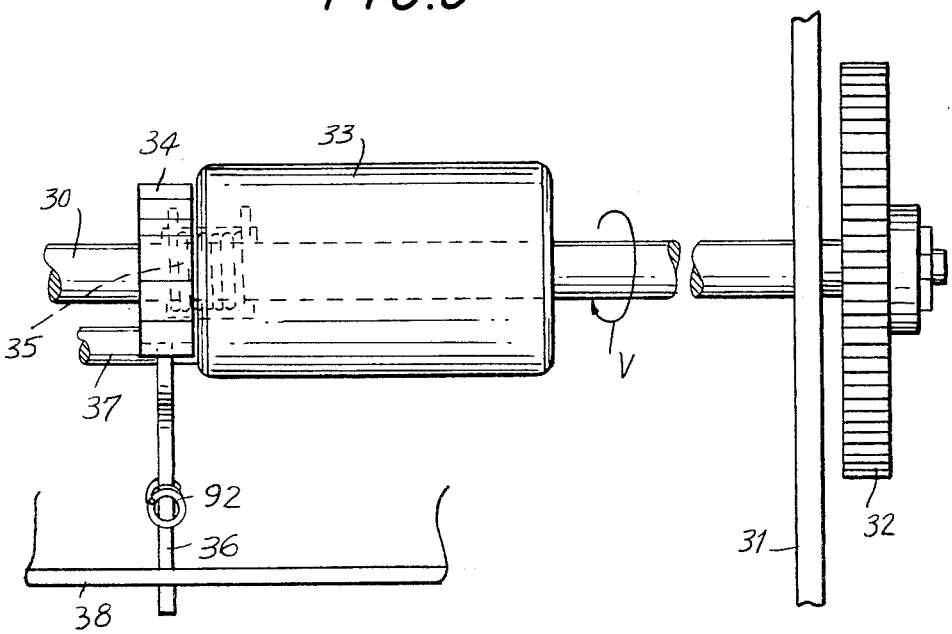
FIG. 9 is a front plan view, partially cut away, of the paper feeding mechanism depicted in FIG. 8.

Reference is now made to FIGS. 8 and 9 wherein the paper feeding mechanism 5 of the printer is depicted. A paper feeding drive shaft 30 is rotatably secured between the two frames 31 of the printer. The rotation of motor 9 depicted in FIGS. 6 and 7 is transmitted from planet driving gear 11 to paper feeding drive gear 32 which is integrally secured to drive shaft 30. As motor 9 is rotated, the paper feeding drive shaft 30 will be rotated in the direction of arrow V.

A paper feeding roller 33, a paper feeding ratchet 34 and a spring 35 whose ends are engaged to roller 33 and ratchet 34, respectively, are coaxially disposed on paper feeding drive shaft 30. Spring 35 operates as a spring clutch. Accordingly, when the paper feeding drive shaft 30 is rotated in the direction of arrow V, spring 35 will remain loose and drive shaft 30 will rotate therein. Paper feeding roller 33 and paper feeding ratchet 34 will not be rotated in this condition.

Alternatively, when locking or control lever 36 which operates as a pawl for ratchet 34 is disengaged from paper feeding ratchet 34, spring 35 will be tensioned around shaft 30 and will be rotated by shaft 30. Accordingly, paper feeding roller 33 will be rotated along with spring 35 and the printing paper 47 will be advanced. When the paper is fed and the next tooth portion of paper feeding ratchet 34 is engaged with control lever 36, spring 35 will again be loosened and the rotation of shaft 30 will not be transmitted to paper feeding roller 33.

Control lever 36 is rotatably attached onto shaft 37 which is supported by frames 31 and is normally engaged with paper feeding ratchet 34 due to the force exerted by means of spring 92. A selecting lever 38 is also rotatably attached onto shaft 37, as described in detail below. An electromagnet 39 is mounted in spaced relation from selecting lever 38.

The operation of the paper feeding mechanism will now be described. First, selecting lever 38 is attracted by applying appropriately timed drive signals to electromagnet 39. As described below, selecting lever 38 is selectively and operatively enaged with control lever 36. As selecting lever 38 is attracted to the electromagnet 39, control lever 36 will be rotated in clockwise direction (FIG. 8) around shaft 37. The pawl portion of control lever 36 will disengage from paper feeding ratchet 34. Spring 35 will accordingly be tightened. A paper pressing roller 40 which presses the paper 47 against paper feeding roller 33 is also provided for frictionally engaging the printing paper therebetween. The paper feeding roller 33 will be rotated by drive shaft 30 and the paper will accordingly be advanced through the printer.

Figure 10:
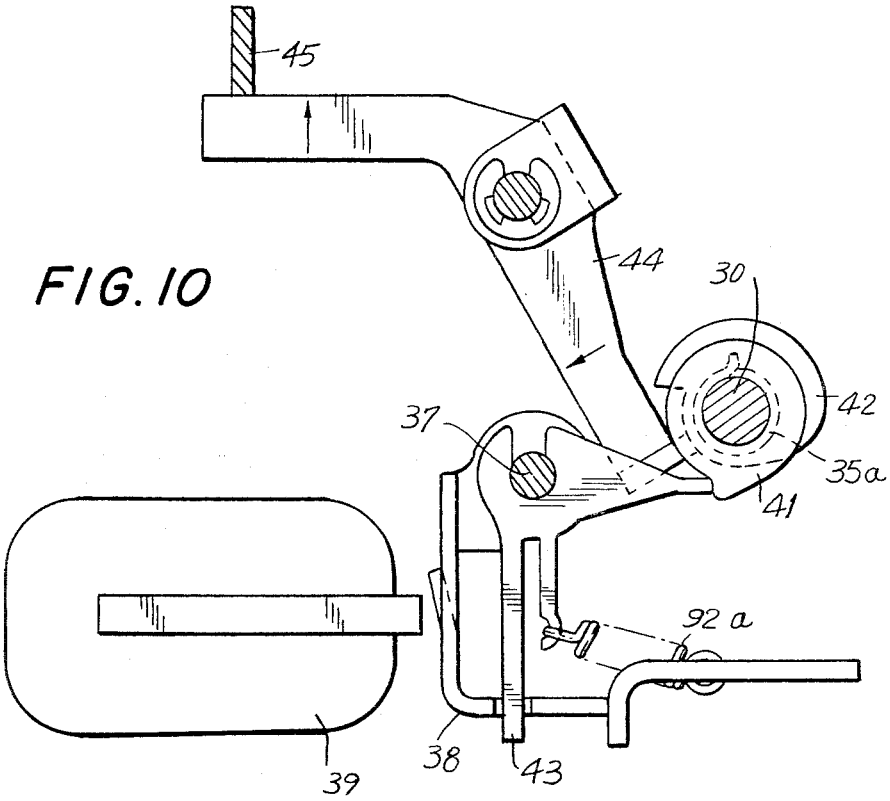
FIG. 10 is an enlarged side elevational view of the stamping mechanism utilized in the printer of the instant invention.
Figure 11:
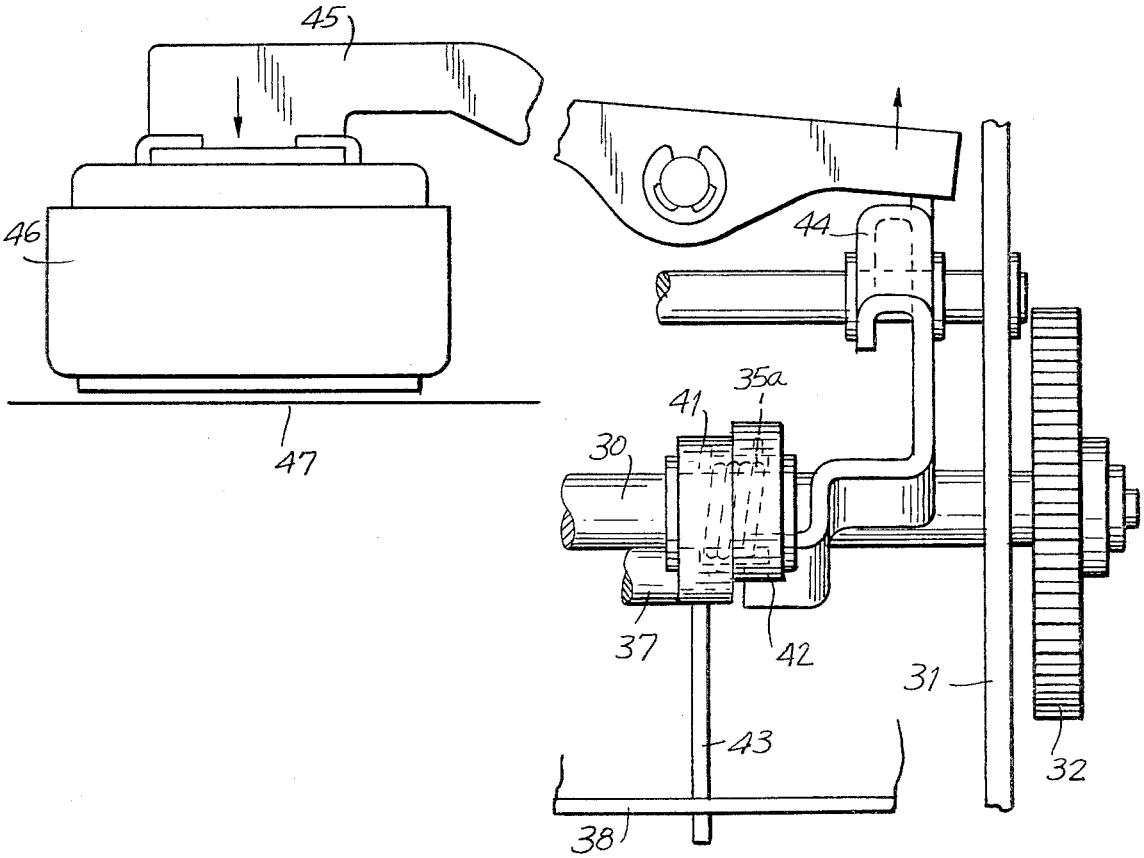
FIG. 11 is a front plan view, partially cut away, of the stamping mechanism depicted in FIG. 10.

Reference is now made to FIGS. 10 and 11 in order to explain the operation of the stamping mechanism. The principle of operation of the stamping mechanism is substantially the same as that of the paper feeding mechanism depicted in FIGS. 8 and 9. Stamp 46 may include various characters or indicia such as the name or logo of the store where the receipt is to be given. The stamping mechanism will stamp print this name or logo onto the receipt printing paper in the manner explained hereafter.

Paper feeding ratchet 34 in FIG. 8 corresponds to a stamping ratchet 41 and paper feeding roller 33 in FIGS. 8 and 9 corresponds to a stamping cam 42. A stamping control lever 43 is in the same configuration as the paper feeding control lever 36 and is normally engaged with stamping ratchet 41 due to the force exerted thereon by spring 92*a*. The paper feeding drive shaft 30, control lever shaft 37, selecting lever 38 and electromagnet 39 are used in common. As explained below, the stamping mechanism is arranged in parallel relation to the paper feeding mechanism.

The operation of the stamp printing mechanism is now explained. When a current is passed through the electromagnet 39 in a different timing sequence than that for the paper feeding mechanism, selecting lever 38 is attracted in the same manner as discussed above. Selecting lever 38 will engage with control lever 43 as described below and will cause control lever 43 to rotate in a clockwise direction (FIG. 10). Control lever 43 will disengage from stamping ratchet 41. A spring 35*a* will tighten around drive shaft 30 and will cause ratchet 41 and stamping cam 42 to rotate. Since the stamping ratchet 41 has only one pawl-receiving portion on the periphery thereof, stamping ratchet 41 and stamping cam 42 will be rotated once during one electrical conduction of the electromagnet. The rotation of the stamping cam will cause the pivoting of stamping cam lever 44. Stamping cam lever 44 is operatively coupled to stamping driving lever 45. Accordingly, stamp 46 secured to stamping driving lever 45 will be pressed against paper 47 and will leave its imprint thereon.

Figure 12:
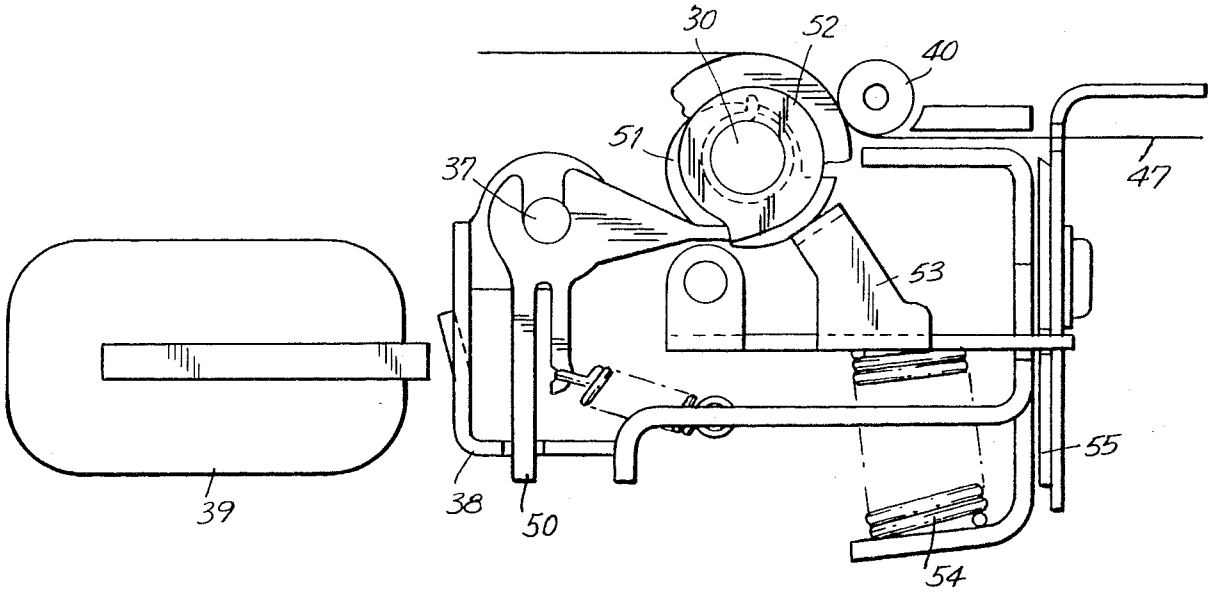
FIG. 12 is an enlarged side elevational view of the autocutting mechanism utilized in the printer of the instant invention.

Reference is now made to FIG. 12 in order to explain the operation of the auto-cutting mechanism. The operating principle of this mechanism is substantially the same as that described above with respect to the stamping mechanism in FIGS. 10 and 11. An auto-cutting cam 51 in the same configuration as stampng cam 42 is provided on drive shaft 30. The auto-cutting mechanism is arranged in parallel relation to the paper feeding mechanism and the stamping mechanism. However, auto-cutting cam 51 is mounted in a different position with respect to cutter ratchet 52 than the similar parts in the stamping mechanism. When auto-cutting cam 51 is in the standby position, it pushes cutter lever 53 down (FIG. 12). When the electromagnet 39 is activated and selecting lever 38 is attracted, auto-cutting control lever 50 will be rotated in a clockwise direction (FIG. 12). Auto-cutting cam 51 will be caused to rotate in the same manner as the stamping mechanism cam and cutter lever 53 will drop by the amount of the step difference of the auto-cutting cam 51 due to the force exerted by a spring 54. Cutter 55 which is coupled to cutter lever 53 will be forced in upward direction (FIG. 12) due to the displacement of cutter lever 53. Cutter 55 will accordingly cut printing paper 47.

Figure 13:
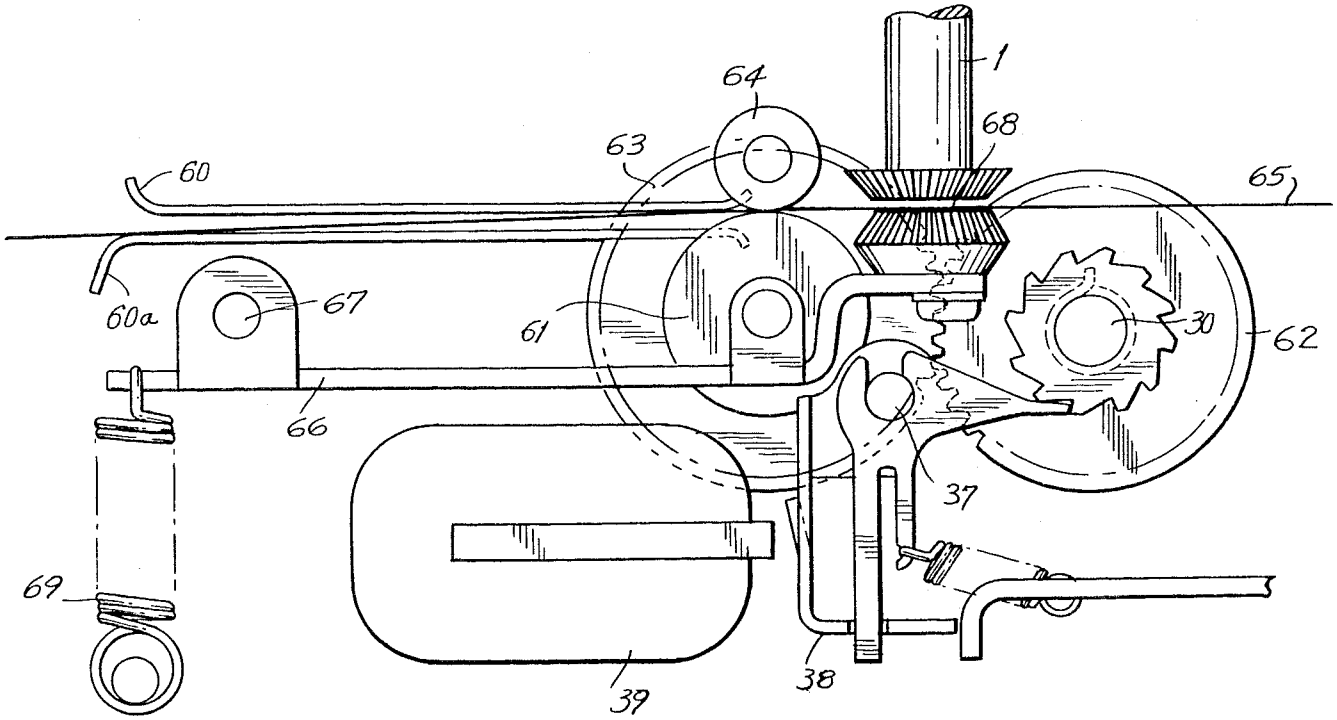
FIG. 13 is an enlarged side elevational view of the slip paper feeding mechanism utilized in the printer of the instant invention.

Reference is now made to FIG. 13 wherein a slip paper feeding mechanism which can be utilized in connection with the printer of the instant invention, is depicted. A slip, such as a charge receipt or the like can be slid between guides 60 and 60*a* so that printing by dot head 1 can be effected thereon. The slip paper feeding mechanism depicted in FIG. 13 advances the slip past the dot head 1 so that consecutive lines can be printed thereon. The operating principle of the slip paper feeding mechanism is substantially the same as the paper feeding mechanism described above with reference to FIGS. 8 and 9. However, since the position of the slip paper feeding roller 61 is different, gear 62 is provided on drive shaft 30 instead of the paper feeding roller 33 in the paper feeding mechanism. Gear 62 is engaged with gear 63 in order to transmit the rotation thereof to slip paper feeding roller 61.

Slip paper feeding roller 61 is attached to lever 66 in order to keep the slip feeding roller 61 against the slip pressing roller 64. Lever 66 is pivotally coupled to lever shaft 67. Lever 66 is pressed by the force of a spring 69 so that slip feeding roller 61 always presses a roller 64. Platen 68 is mounted on slipping lever 66 in order to automatically regulate the distance between dot head 1 and platen 68 in order to allow for various thicknesses of slip paper 65. The operation of the slip paper feeding mechanism is otherwise the same as that described above with reference to the paper feeding mechanism depicted in FIGS. 8 and 9.

Figure 15:
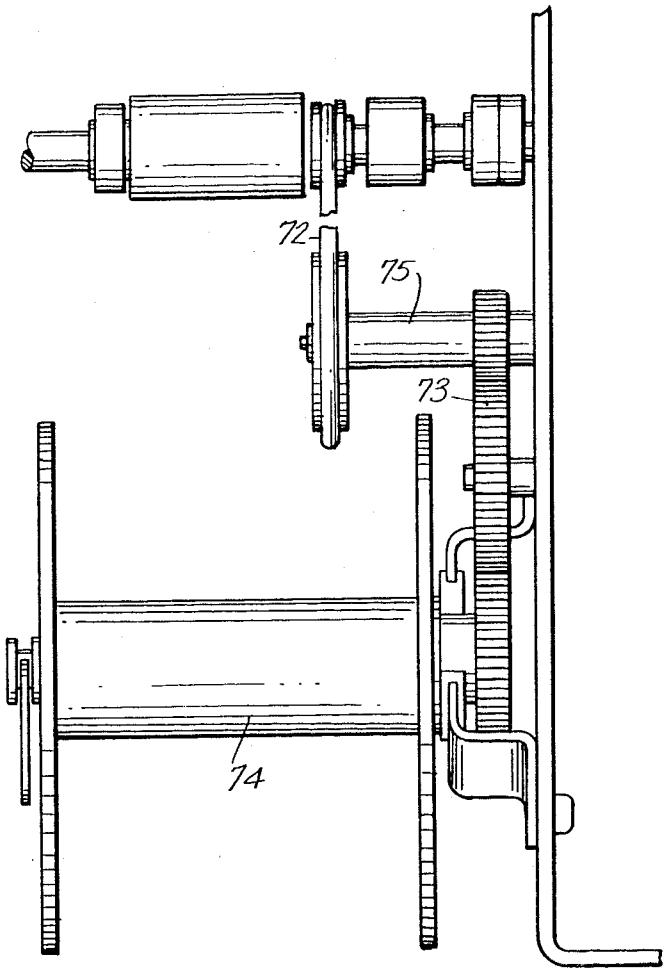
FIG. 15 is a front plan view of the journal paper winding mechanism depicted in FIG. 14.
Figure 14:
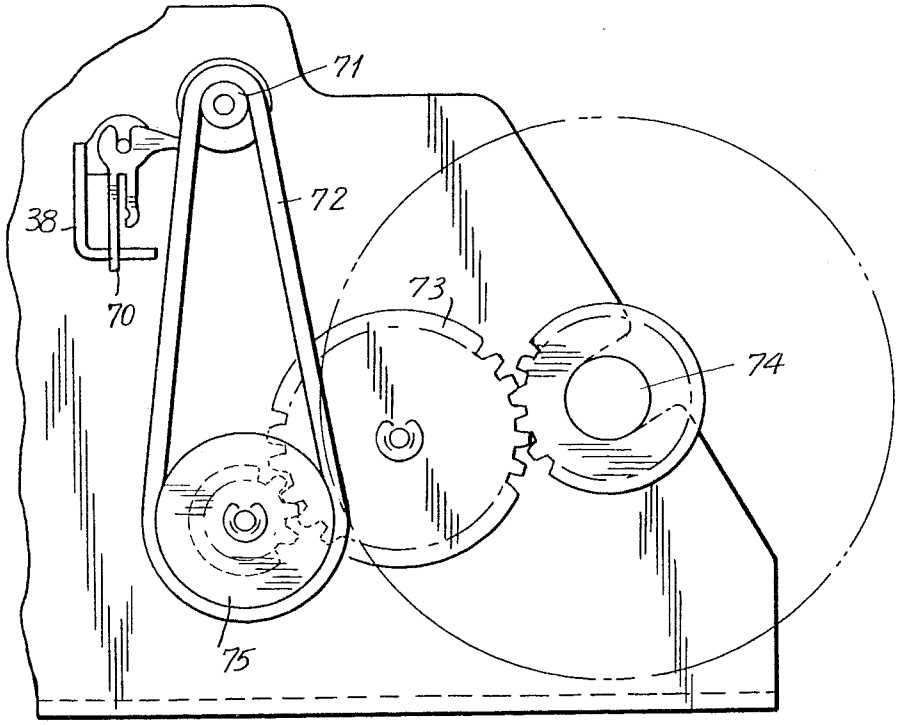
FIG. 14 is an enlarged side elevational view of the journal paper winding mechanism utilized in the printer of the instant invention.

Reference is now made to FIGS. 14 and 15 in order to explain the operation of the journal paper winding mechanism. The journal printing paper is the paper which is stored in the cash register after printing has been effected thereon in order to provide a permanent record of the transactions for the user. Since it is only the journal paper that is to be wound within the printer, the rotation of the journal paper feeding mechanism described above with reference to FIGS. 8 and 9 is transmitted from a journal paper feeding roller 71 by means of a winding coil spring 72 to a pulley 75. The rotation of pulley 75 is transmitted by means of a wind transmitting gear 73 to winding shaft 74. The amount of rotation which is required for feeding the journal paper is different than the amount of rotation needed for winding the journal paper on winding shaft 74. Accordingly, the excess amount of rotation is allowed to slip between winding spring 72 and pulley 75. It is noted that the amount of rotation for journal paper feeding is as a matter of course, different than the amount of rotation for journal paper winding. The journal paper winding mechanism includes a control lever 70 similar to the control levers described above which is selectively operated by selecting lever 38.

Figure 16:
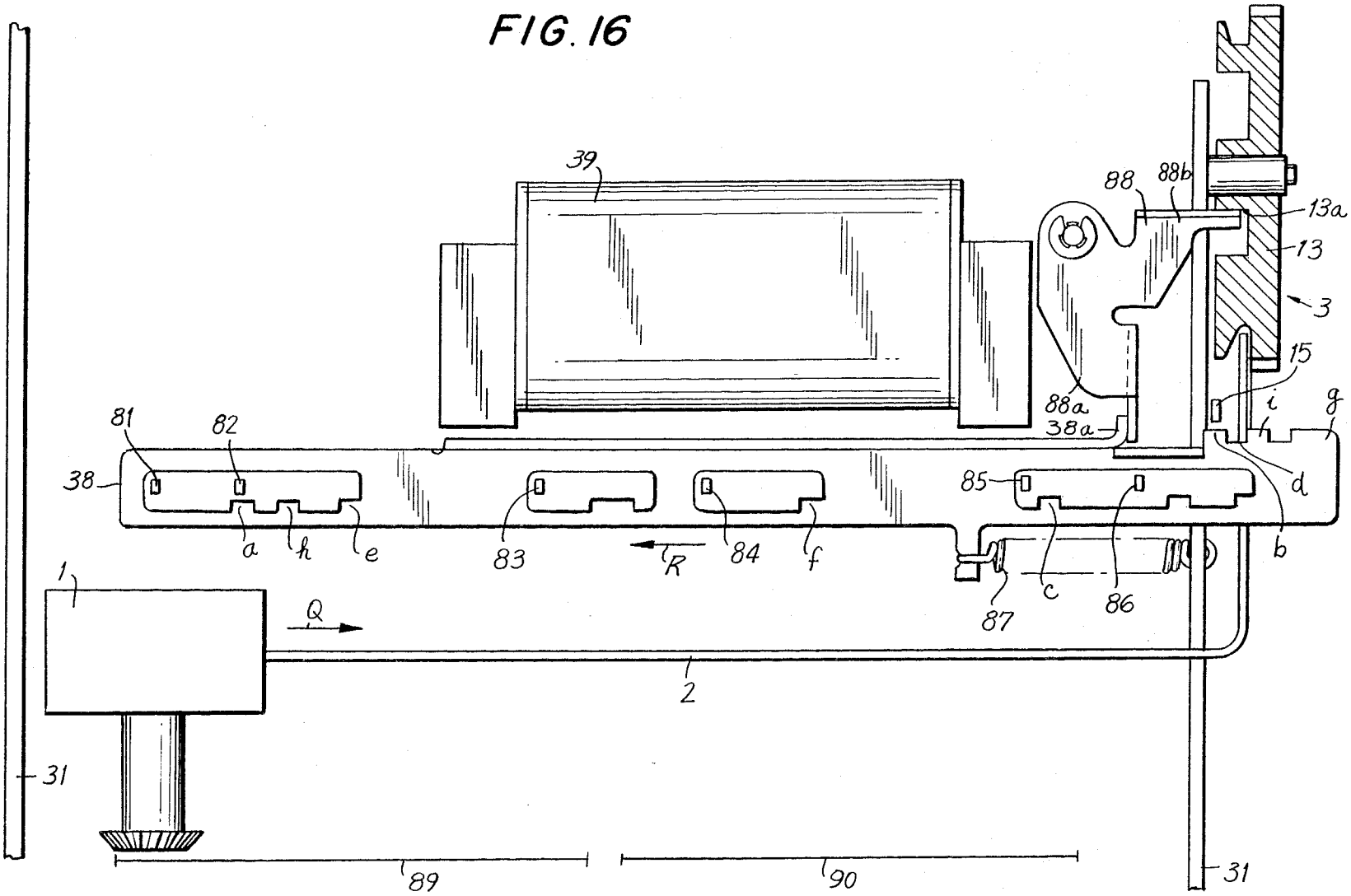
FIG. 16 is an enlarged top plan view of the printer drive and control assembly constructed and arranged in accordance with the instant invention.
Figure 18:
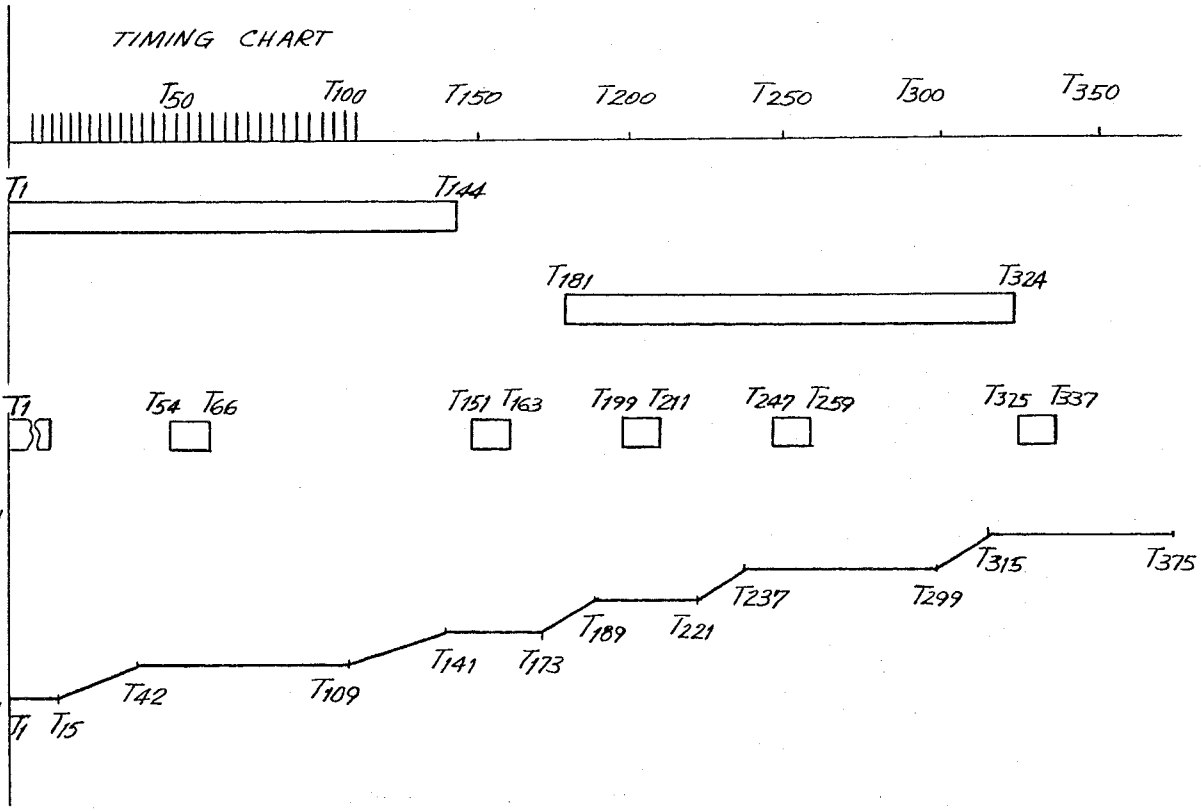
FIG. 18 is a timing chart illustrating the timing of the operation of various mechanisms in the printer of the instant invention.
Figure 17:
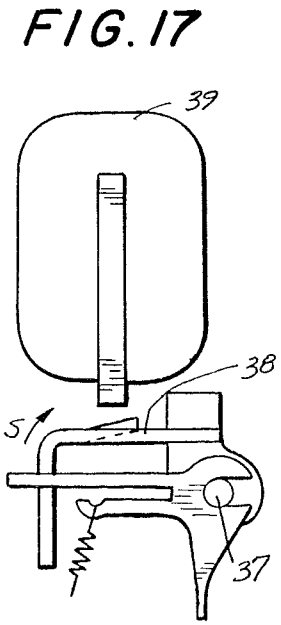
FIG. 17 is a side elevational view of the printer drive and control assembly depicted in FIG. 16.

Reference is now made to FIGS. 16 through 21 in order to explain the arrangement of the various mechanisms within the printer of the instant invention and the method of operating all of the various mechanisms with only one electromagnet. FIGS. 16 and 17 depict the construction and operation of the printer. FIG. 18 is a timing chart illustrating the various timings of selecting lever 38 with respect to the various mechanisms in the printer.

Each control lever of each of the various mechanisms described above is arranged in sequential fashion between frames 31. As depicted in FIG. 16, 81 is the control lever for the auto-cutting mechanism, 82 is the control lever for the receipt paper feeding mechanism, 83 is the control lever for a partial cutting mechanism which is similar in structure to the auto-cutting mechanism depicted in FIG. 12, 84 is the control lever for the journal paper feeding mechanism, 85 is the control lever for the stamping mechanism and 86 is the control lever for the slip paper feeding mechanism. Planet locking or control lever 15 of the dot head driver mechanism is provided on the outside of frame 31 in printing head driving mechanism 3. Selecting lever 38 includes several specially configured cutout portions for allowing the control levers to extent therethrough. Selecting lever 38 is held in its standby position as depicted in FIG. 16 due to the force exerted by a selecting lever spring 87.

A selecting drive lever 88 is pivotally coupled to the printer housing. A first extending arm **88*a* is engaged against an abutting tab 38*a* of selecting lever 38. A second arm 88*b* of selecting drive lever 88 which acts as a cam shaft extends against a caming surface 13*a* formed on the inside of wire driving gear 13. The shape of cam 13*a* on wire driving gear 13 is depicted in FIG. 19**.

Figure 19:
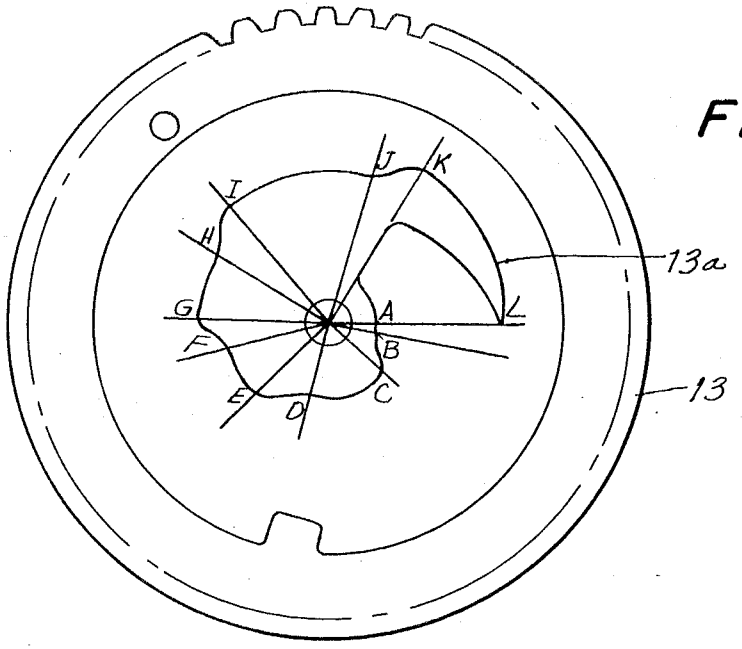
FIG. 19 is a top plan view depicting the shape of the driving cam of the printer of the instant invention.

When selecting lever 38 is in its standby position, second arm **88*b* of selecting drive lever 88 is located in portion A of caming surface 13*a* depicted in FIG. 19. Dot head 1 is connected to wire driving gear 13 by means of wire 2 and is located at the left end (FIG. 16) in the standby position between the printing housing frame 31 depicted in FIG. 16. As motor 9 (FIGS. 6 and 7) and, hence, wire driving gear 13 is rotated, selecting lever 38 will be caused to translate by degrees in the direction of arrow R by means of the force exerted thereon by selecting drive lever 88 which is driven by caming surface 13*a*. The rotation of caming surface 13*a* will cause selecting drive lever 88 to pivot in a clockwise direction as depicted in FIG. 16. At the same time, since wire driving gear 13 is caused to rotate, wire 2 attached thereto will be pulled thereby causing the translation of dot head 1 in the direction of arrow Q. As dot head 1 begins to translate, it applies resetting signals and starts to count the timing signals applied from motor 9**.

Figure 20:
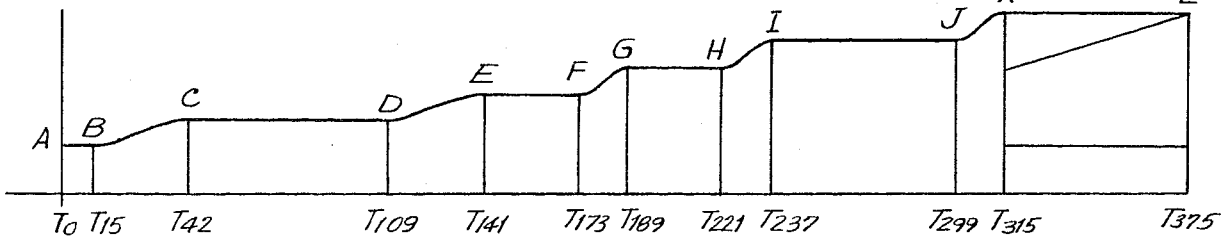
FIG. 20 is a graphic representation of the developmental positioning of the selecting lever of the printer of the instant invention as driven by the driving cam depicted in FIG. 19.

The movements of dot heat 1 and of selecting lever 38 are illustrated in the timing chart of FIG. 18. Selecting lever 38 remains in the standby position from the time when dot heat 1 begins to move until the passage of 15 time periods from T1 to T15, during which dot head 1 can print on the receipt printing paper 89. Thereafter, selecting lever 38 is translated for one step in the period from T15 to T42 and then remains in that position for a period from T42 to T109. As illustrated in FIGS. 18 and 20, the selecting lever 38 is stopped in six separate positions in gradual steps while dot head 1 is translated across the surface of the receipt and journal papers.

If the electromagnet 39 is electrically conducted when selecting lever 38 is in a given stopped position, selecting lever 38 will be pivoted around selecting lever shaft 37 in the direction of arrow S. Then, the control lever for starting the necessary mechanisms which are engaged with tab portions extending into the cutouts in selecting lever 38 are pivoted thereby. Thereafter, the control lever releases the particular ratchet to which it is normally engaged, and the necessary operations are completed. At the same time, the control levers for the unnecessary mechanisms are provided with a notched portion in the cutouts in selecting lever 38 so as not to be engaged therewith. In each printing cycle, taking as an example the paper feeding operation, there is the operation to complete printing and to feed the paper in the position where dot head 1 is stopped. Selecting lever 38 is also engaged with planet locking or control lever 15 in order to control the drive of dot head 1.

The operation of the various mechanisms in the printer of the instant invention will now be explained. When, during period T1–T15, electromagnet 39 is electrically conducted, selecting lever 38 will be attracted to the electromagnet 39 and will accordingly pivot. Control lever 82 of the receipt paper feeding mechanism is operated by tab a and planet locking lever 15 is operated by tab b. Hence, the receipt paper 89 is advanced and dot head 1 is reset and stopped. In order to feed the paper for more than one line, the time width of the electrical conduction to the electromagnet 39 can be widened so that selecting lever 38 remains engaged with control lever 82 and planet locking lever 15.

By operating motor 9 when dot head 1 is in the standby position, dot head 1 will be laterally translated and the other mechanisms will not operate. While dot head 1 is displaced in registration with receipt paper 89 or journal paper 90, printing may be effected by actuation of dot head 1 by driving signals in a well known manner not forming a part of this invention. When dot head 1 reaches timing position T54, dot head 1 is capable of printing on receipt paper 89 and selecting lever 38 is in the position where it is laterally translated by one step. At this time, by electrically conducing the electromagnet 39 for a period from T54 to T66, control lever 85 for the stamping mechanism is pivoted by tab c of the selecting lever and the stamping mechanism will stamp print on the receipt paper. At this time, planet locking lever 15 will not be pivoted since planet locking lever 15 will extend into notch d of the selecting lever.

If motor 9 continues to operate, both stamp printing and printing by dot head 1 will be simultaneously done. By electrically conducting the electromagnet 39 for a period from T325 to T337, dot head 1 having been translated across both receipt paper 89 and journal paper 90, the selecting lever 38 is in the sixth position where it is translated as far as possible to the left, as depicted in FIG. 16. Control levers 82, 84 and 85 will be operated by tabs e, f and g of selecting lever 38, respectively. The receipt paper feeding mechanism and the journal paper feeding mechanism will be operated and dot head 1 will be returned to its initial standby position.

If electromagnet 39 is electrically conducted for a period from T151 to T163, dot head 1 will have completed printing on receipt paper 89. Control lever 82 of the receipt feeding mechanism and planet locking lever 15 will be driven by tabs h and i of selecting lever 38 and only receipt paper 89 will be fed and dot head 1 will return to its initial standby position and stop. Moreover, by electrically conducting the electromagnet 39 for a period from T199 to T211, the auto-cutting control lever 81 will be pivoted and the receipt paper 89 will be cut off fully. In addition, planet locking lever 15 will be pivoted by tab g and dot head 1 will be reset and stopped. By electrically conducting the electromagnet 39 from T247 to T259, control lever 83 will be operated and the receipt will be partially cut off and dot head 1 will be returned to its initial standby position.

Figure 21:
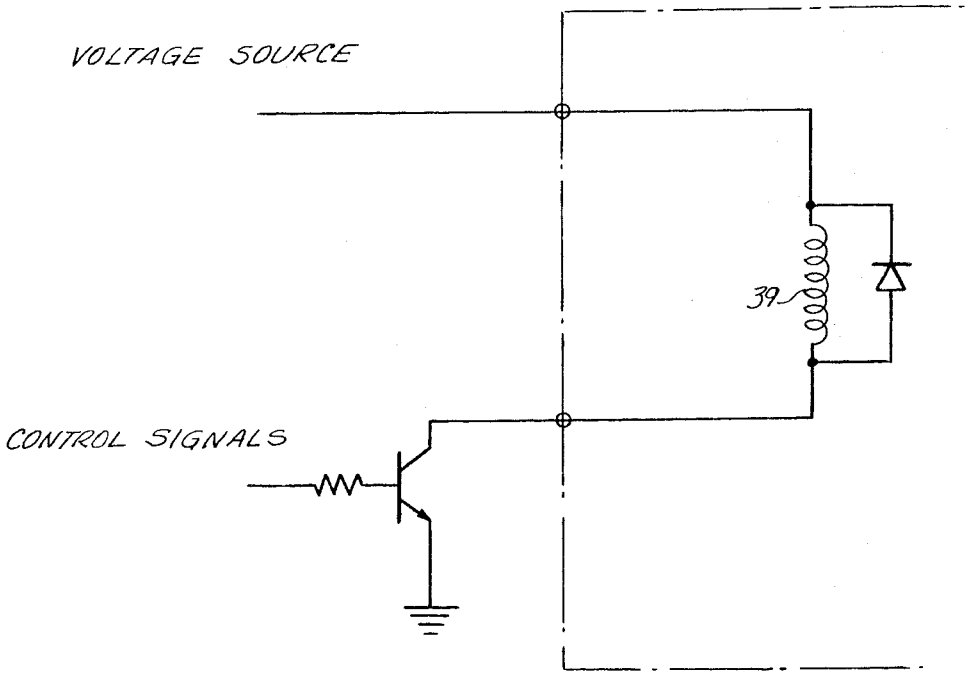
FIG. 21 is a schematic wiring diagram of the driver of the electromagnet utilized in the printer of the instant invention.

Selecting lever 38 is translated by degrees so that the operation of attraction by electromagnet 39 is stable and the engagement with the particular control lever will be insured by stopping the selecting lever 38 in a particular position at the time of attracting by means of electromagnet 39. Since it is only one electromagnet 39 that starts each of the various mechanisms in the printer, only one driver in the printing driving circuit is necessary as depicted in FIG. 21.

As aforenoted, the present invention allows for all of the various mechanisms in the printer to be operated by selectively timing the electrical conduction of only one electromagnet 39 by arranging selecting lever 38 and the control levers as described herein for each of the various mechanisms. In addition, the return of dot head 1 to its initial standby position which proved difficult in the conventional printer, can easily be done. Accordingly, the dot head does not need to be translated across both the receipt and journal papers even when only printing a partial line, such as the data, on the receipt paper. Thus, the printing itself will be highly speeded up. This means that the waiting time for issuing the receipt is shortened which provides a great advantage when the printer is utilized in an electric cash register or the like.

In the instant invention, only one driver is required since only one electromagnet is utilized. Accordingly, the number of parts in the printer of the instant invention is reduced. Moreover, substantially the same principles of operation are utilized in driving each of the various mechanisms in the printer and as a result, many of the same parts can be utilized for the various control levers, ratchets and related parts. Therefore, the cost of the printer is substantially decreased. It is noted that the present invention provides a principle of operation which is applicable in fields other than the serial printer.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer adapted for printing on a recording medium comprising frame means, printing means slidably mounted on said frame means for reciprocal displacement across said recording medium and drive means mounted on said frame means for laterally displacing said printing means across said recording means, first lever means supported by said frame means for controlling the actuation of said drive means, said first lever means being normally engaged with said drive means to enable said drive means to displace said printing means, paper feeding means for advancing said recording medium past said printing means, second lever means supported by said frame means for controlling the actuation of said paper feeding means, said second lever means being normally engaged with said paper feeding means so that said paper feeding means is not actuated, selecting means supported by said frame means so as to be operatively coupleable with said first and second lever means, displacement means driven by said drive means for selectively transversely displacing said selecting means along a path with respect to said first and second lever means, and a single electromagnet for selectively pivoting said selecting means with respect to said first and second lever means at positions along the path of transverse displacement of said selecting means to operably couple said selecting means to said first and second lever means for selective actuation of said drive means and said printing means.

2. The printer as claimed in claim 1, wherein said drive means includes gear means and motor means for driving said gear means, said first lever means being normally coupled to said gear means when said first lever means is not operatively coupled to said selecting means.

3. The printer as claimed in claim 2, wherein said gear means includes a driving gear, said drive means including a wire means coupled intermediate said printing means and said driving gear for transmitting the rotational motion of said driving gear to said printing means so that said printing means is laterally displaced across said recording means when said driving gear is driven by said motor means.

4. The printer as claimed in claim 3, wherein said gear means further includes a planet driving gear intermediate said motor means and said driving gear for transmitting the rotation of said motor means to said driving gear, a planet lever pivotably mounted coaxially with said planet driving gear, at least one planet gear supported on said planet lever for drivingly coupling said planet driving gear and driving gear at a first orientation of said planet lever and being out of driving coupling at other orientations of said planet lever, said first lever means having a first pawl, said planet lever having engagement means, said first pawl being normally engaged with said engagement means on said planet lever to position said planet lever at its first orientation.

5. The printer as claimed in claim 4, and including spring means coupled between said frame means and said printing means for tensioning during driving displacement of said printing means and for return of said printing means to a standby position when said planet driving gear is out of driving coupling with said driving gear.

6. The printer as claimed in claim 1, including a drive shaft, said paper feeding means including first ratchet means rotatably secured to said drive shaft, said second lever means including a second pawl for engagement with said ratchet means.

7. The printer as claimed in claim 6, wherein said paper feeding means includes a paper feeding roller disposed on said drive shaft and clutch spring means having two ends disposed on said drive shaft, a first end of said clutch spring means being secured to said first ratchet means and the second end of said clutch spring means being secured to said roller.

8. The printer as claimed in claim 1, including motor means for driving said drive means.

9. The printer as claimed in claim 1, wherein said recording medium includes a receipt paper and a journal paper, said paper feeding means being a receipt paper mechanism for advancing said receipt paper; and further including a journal paper feeding mechanism for advancing said journal paper, and a third lever means normally engaged with said journal paper feeding mechanism for controlling the actuation of said journal paper feeding mechanism and generally coupleable to said selecting means at a position on the path thereof.

10. The printer as claimed in claim 9, wherein said receipt paper feeding mechanism includes a second ratchet means and said journal paper feeding mechanism includes a third ratchet means, said second lever means including a second pawl for engagement with said second ratchet means and said third lever means including a third pawl for engagement with said third ratchet means.

11. The printer as claimed in claim 10, wherein said second and third pawls are normally engaged with said second and third ratchet means respectively, said second and third pawls being out of engagement with said second and third ratchet means, respectively, when said selecting means is operatively coupled to said second and third lever means, respectively.

12. The printer as claimed in claim 11, including a drive shaft, said second and third ratchet means being rotatably disposed on said drive shaft, a motor driving said drive shaft and a second shaft supported by said frame means, said second and third lever means being rotatably disposed on said second shaft in registration with said second and third ratchets respectively.

13. The printer as claimed in claim 11, wherein said receipt paper feeding mechanism and said journal paper feeding mechanism advance said receipt paper and said journal paper, respectively, only when said second and third pawls are removed from said second and third ratchets, respectively.

14. The printer as claimed in claim 13, wherein said displacement means transversely displaces said selecting means along a path with respect to said first, second and third lever means between at least a first position where said selecting means is operatively coupleable to at least said first lever means and said second lever means and a second position where said selecting means is operatively coupleable to at least said first lever means and said third lever means.

15. The printer as claimed in claim 14, including stamping means for stamping characters or designs on said recording medium and fourth lever means for controlling the actuation of said stamping means, said selecting means being operatively coupleable to said fourth lever means in a fourth position of said selecting means along said path.

16. The printer as claimed in claim 15, wherein said stamping means includes fourth ratchet means having at least one tooth, said fourth lever means including a fourth pawl for engagement with said tooth on said fourth ratchet means.

17. The printer as claimed in claim 16, including a drive shaft, said second, third and fourth ratchets being rotatably disposed on said drive shaft, a motor driving said drive shaft, and a second shaft supported by said frame means, said second, third and fourth lever means being rotatably supported on said shaft in registration with said second, third and fourth ratchets, respectively.

18. The printer as claimed in claim 15, wherein said selecting means is displaceable by said displacement means into a plurality of positions, said selecting means being operatively coupleable to said first lever means and said second lever means but not said fourth lever means when in a first position, said selecting means being operatively coupleable to said first lever means and said third lever means but not said fourth lever means when said selecting means is in a second position, said selecting means being operatively coupleable to said fourth lever means but not said second or third lever means when said selecting means is in a third position along said path.

19. The printer as claimed in claim 1, including cutting means for cutting said printing medium after printing has been effected thereon, and a fifth lever means supported by said frame means and operably coupleable with said selecting means for controlling the actuation of said cutting means.

20. The printer as claimed in claim 19, wherein said cutting means is a full cutting mechanism and including a partial cutting mechanism, and sixth lever means operably coupleable with said selecting means for controlling the actuation of said partial cutting mechanism.

21. The printer as claimed in claim 20, wherein said full cutting mechanism and said partial cutting mechanism include fifth and sixth ratchets, respectively, for operating the respective full cutting mechanism and partial cutting mechanism, and including a drive shaft, said fifth and sixth ratchets being rotatably disposed on said drive shaft, and a second shaft, said fifth and sixth lever means being disposed on said second shaft in registration with said fifth and sixth ratchets, respectively, said fifth and sixth levers each including a pawl for operative coupling, respectively, with said fifth and sixth ratchets.

22. The printer as claimed in claim 21, wherein said paper feeding means includes a second ratchet rotatably mounted on said drive shaft, said second lever means being mounted on said second shaft and including a pawl for operative coupling with said second ratchet.

23. The printer as claimed in claim 19, wherein said displacement means transversely displaces said selecting means along a path with respect to said first, second and fifth lever means between at least a first position where said selecting means is operatively coupleable to at least said first and second lever means and a second position where said selecting means is operatively coupleable to at least said first and fifth lever means.

24. The printer as claimed in claim 22, including a slip paper feeding mechanism and seventh lever means operatively coupleable to said selecting means at a position along the path thereof and controlling the actuation of said slip paper feeding mechanism.

25. The printer as claimed in claim 23, including a slip paper feeding mechanism including seventh ratchet means disposed on said drive shaft, and seventh lever means operatively coupleable to said selecting means and disposed on said second shaft in registration with said seventh ratchet means.

26. The printer as claimed in claim 14, 18, or 23, wherein said selecting means includes a plurality of tabs projecting therefrom, said displacement means displacing said selecting means so that said tabs are selectively brought into registration with predetermined ones of said lever means, said electromagnet pivoting said selecting means so that said tabs actuate the predetermined ones of said lever means.

27. The printer as claimed in claim 14, 18 or 23, wherein said displacement means includes a camming surface displaceably supported by said frame means, a cam follower engaging said camming surface and coupled to said selecting means for biasing said cam follower against said camming surface and means for displacing said camming surface relative to said cam follower for displacing said cam follower and therefore said selecting means.

28. The printer as claimed in claim 27, wherein said camming surface includes regions shaped so that the displacement of said selecting means is stopped at said positions along said path while said camming surface is continuously displaced.

29. The printer as claimed in claim 28, including a cam member rotatably mounted on said frame means about an axis, said camming surface extending about said axis on said cam member, said caming surface regions defining arcs of circles having said axis as a center.

30. The printer as claimed in claim 29, wherein said drive means includes gear means and motor means for driving said gear means, said first lever means being normally coupled to said gear means when said first lever means is not operatively coupled to said selecting means.

31. The printer as claimed in claim 30, wherein said gear means and cam member are mounted for common rotation.

32. The printer as claimed in claim 31, wherein said gear means further includes a planet driving gear intermediate said motor means and said driving gear for transmitting the rotation of said motor means to said driving gear, a planet lever pivotably mounted coaxially with said planet driving gear, at least one planet gear supported on said planet lever for drivingly coupling said planet driving gear and driving gear at a first orientation of said planet lever and being out of driving coupling at other orientations of said planet lever, said first lever means having a first pawl means, said planet lever having engagement means, said first pawl being normally engaged with said engagement means on said planet lever to position said planet lever at its first orientation.

33. The printer as claimed in claim 32, and including spring means coupled between said frame means and said printing means for tensioning during driving displacement of said printing means and for return of said printing means to a standby position and said selecting lever to a predetermined position on said path when said planet driving gear is out of driving coupling with said driving gear.

* * * * *

UNITED STATES PATENT AND TRADEMARK OFFICE

CERTIFICATE OF CORRECTION

PATENT NO. : 4,357,116

DATED : November 2, 1982

INVENTOR(S) : Yuhei Oguchi

It is certified that error appears in the above—identified patent and that said Letters Patent is hereby corrected as shown below:

In column 1 of the cover page, after

"[22] Filed: Dec. 23, 1980", insert --[30] Foreign Application Priority Data

Dec. 28, 1979 [JP] Japan....54/172231--.

Signed and Sealed this

*Fifteenth* Day of *February 1983*

[SEAL]

*Attest:*

GERALD J. MOSSINGHOFF

*Attesting Officer*

*Commissioner of Patents and Trademarks*